United States Patent [19]

Arnett

[11] 4,253,377

[45] Mar. 3, 1981

[54] FIREARM OF INTERCONVERTIBLE CALIBERS

[76] Inventor: Perry J. Arnett, 97 S. 100 East, Parowan, Utah 84761

[21] Appl. No.: 951,030

[22] Filed: Oct. 13, 1978

[51] Int. Cl.[3] ..... F41D 11/00

[52] U.S. Cl. ..... 89/163; 42/25; 42/77

[58] Field of Search ..... 42/77; 89/29, 128, 163, 89/196

[56] References Cited

U.S. PATENT DOCUMENTS

| | | | |
|---|---|---|---|
| 745,561 | 12/1903 | Bergersen | 42/77 |
| 3,504,594 | 4/1970 | Greeley | 89/163 |
| 4,127,056 | 11/1978 | Kart | 89/196 |

OTHER PUBLICATIONS

James M. Triggs, "Colt Automatic .32 and .380 Pocket Pistol", NRA Illustrated Firearms Assembly Handbook, p. 6.

*Primary Examiner*—Stephen C. Bentley

[57] ABSTRACT

An automatic pistol of the breech block type which is interconvertible to fire sub-caliber cartridges. The frame, handle, slide, ejector and firing mechanism of the larger caliber pistol are used when converting for sub-caliber usage. A sub-caliber barrel is mounted in the slide and detachably connected to the frame by a pivotal link. An interchangeable barrel bushing adapted to support the forward end of the sub-caliber barrel is inserted in the slide. At the forward end of the slide a recoil spring is tensioned to operate the slide upon firing of a sub-caliber cartridge. A sub-caliber magazine is inserted in the handle. The extractor is cambered and is sufficiently flexible to capture and extract cartridges of both calibers. The cartridge locating recess in the breech face is that of the larger caliber.

4 Claims, 4 Drawing Figures

FIREARM OF INTERCONVERTIBLE CALIBERS

BACKGROUND OF THE INVENTION

This invention relates to an automatic pistol adaptable to fire cartridges of different calibers. More specifically, this invention relates to an automatic pistol of the breech block type interconvertible to fire cartridges of different calibers.

The conversion of breech block types of automatic pistols such as the Colt Government Model .45 to a subcaliber has usually resulted in a permanent alteration to the sub-caliber. Such conversions have generally utilized the grip or frame end, in some cases, the firing mechanism of the larger caliber pistol, but have required a new slide, extractor and ejector as well as a new barrel and magazine, or permanent alterations to an existing slide, ejector and extractor.

The barrel in a Colt .45 is connected to the frame by a pivotal link and is interlocked to the slide by ribs as well as by tension from a recoil spring mounted in the slide. Upon recoil, the barrel and slide move backwardly together for a short distance. Because of its pivotal linkage to the frame, the rear part of the barrel moves downwardly, disengaging from the slide and allowing the slide to continue its rearward movement. The backward movement of the slide causes the firing mechanism to be cocked and causes the extraction and ejection of the cartridge case. At the end of the backward movement of the slide, the compressed recoil spring moves the slide forward causing a cartridge to be withdrawn from the magazine and pushed into the chamber of the barrel in firing position. Near the end of its forward movement the slide again engages the barrel and the pivotal movement is reversed causing the barrel and slide to interengage.

Previous modifications such as disclosed by Williams, U.S. Pat. No. 2,090,657, alter this form of operation. The subcaliber barrel, instead of being reciprocable, is rigidly secured to the frame. In many conversion kits the new slide is fixedly secured to the barrel, and the rear portion of the slide, referred to as the breech block, retreats to eject an empty case, cock the pistol and returns to firing position, thus loading the firing chamber with a fresh cartridge. These modifications do not contain a locked breech. Without a breechlock the action often starts opening before the bullet is out of the barrel greatly affecting the accuracy of the firearm. Typical conversions are to be found in U.S. Pat. No. 2,872,850; U.S. Pat. No. 2,898,693 and U.S. Pat. No. 3,724,326.

One reason given by gunsmiths for requiring a new slide, or permanent alteration to an existing slide, for sub-caliber conversion is that, due to the great difference in case head size, such as between a 0.45 and 0.38, the slide will not work well with the sub-caliber cartridges. Presumably, this is due to the extractor and the cartridge locating recess in the breechface of the slide being specific to one case head diameter only.

Prior art extractors have been constructed in such a manner that the movement allowed for capturing and extracting a cartridge case has been within very specific dimensional tolerances. If an extractor projects too far into the breech toward the center of the bore, it may interfere with the cartridge during feeding or loading causing the breech block to malfunction or jam. On the other hand, if an extractor rests too far away from the center line of the bore it will fail to interface with the cartridge case head or rim and fail to capture and extract the cartridge case from the firing chamber.

It is also the prevailing opinion of many skilled in the art that a new slide, having a sub-caliber cartridge locating recess, or an existing slide, permanently altered, by reducing the size of the cartridge locating recess (by either "welding-up" and remachining, or permanently installing a bushing) is necessary to prevent the sub-caliber cartridge from becoming dislocated in the breech thus avoiding capture and extraction.

OBJECTS AND BRIEF SUMMARY OF THE INVENTION

It is an object of the present invention to provide an interchangeable sub-caliber conversion unit on a larger caliber pistol wherein the slide and frame of the larger caliber pistol may be utilized without modification when converting to sub-caliber operation.

It is also an object of the invention to provide an interchangeable sub-caliber conversion unit wherein the sub-caliber barrel is pivotally attached to the frame in the same manner as the larger caliber barrel.

Another object of the invention is to provide an interchangeable sub-caliber conversion unit wherein the extractor mounted in the slide is cambered and sufficiently flexible to extract both larger and sub-caliber cartridge cases from the pistol.

A still further object of the invention is to provide an interchangeable conversion unit of the breech block type wherein the cartridge locating breech face recess of the slide is that of the larger caliber.

Yet another object of this invention is to provide an interchangeable conversion unit of the breech block type having a locked breech wherein a 0.45 ACP may be converted to fire 0.38 special wadcutter cartridges.

These and other objects may be accomplished by means of employing the frame, handle, slide, ejector, extractor and firing mechanism of the larger caliber pistol and providing a conversion unit containing sub-caliber parts which are interchangeable with the corresponding larger caliber parts and function in exactly the same manner. A sub-caliber barrel is provided which fits into the slide and is connected to the frame by a pivotal link just like the larger caliber barrel. A barrel bushing supports the sub-caliber barrel at the forward part of the slide and is sized to fit the outside diameter of the barrel. A lighter recoil spring, allowing the slide to function in the normal manner upon the firing of a sub-caliber cartridge, replaces the normal recoil spring. A sub-caliber magazine or magazine insert replaces or modifies the larger caliber magazine. The extractor remains the same for both larger and sub-caliber cartridges but is different from the prior art extractor in that it is cambered so as to capture the cartridge head or rim of both larger and sub-caliber cases, but is resilient or flexible enough not to interfere with the loading of a cartridge from the magazine through the breech into the barrel chamber. The cartridge locating recess in the breech face is not modified, being that of the larger caliber. The hammer spring (main spring) remains the same for both larger and sub-caliber cartridges, but is different from usual prior art in that it is (1) light enough to allow the sub-caliber cartridge recoil force to operate the slide with suffecient rearward force to cam the hammer back, and (2) strong enough to impart adequate force on both the larger and sub-caliber primers to effect positive ignition.

DRAWINGS

DESCRIPTION OF THE INVENTION

Figure 1:
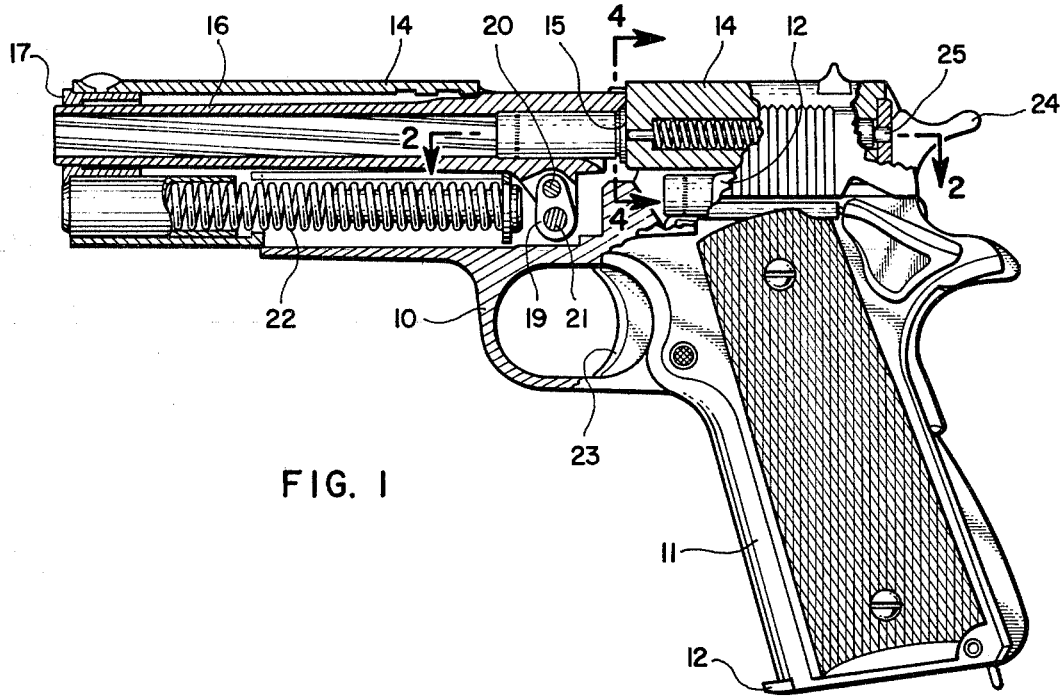
FIG. 1 is a partially broken-away side view of a Colt Government Model .45 automatic pistol modified to fire a sub-caliber cartridge.

An operative embodiment of the invention is shown in FIGS. 1-4. The pistol illustrated is the conventional Colt Government Model .45 as more fully defined in U.S. Pat. Nos. 984,519 and 1,070,582, which is converted to fire 0.38 special wadcutter cartridges.

The pistol comprises a frame 10 having a handle 11 with a cavity therein adapted to receive a magazine 12. Connected to the frame 10 is a sub-caliber barrel 16 and a slide 14 sometimes referred to as a breech block. The rear portion of the slide 14 has a vertical breech face recess 15 which serves to locate the cartridge head and close the breech or chamber of the barrel. The forward projecting portion of the slide 14 surrounds the barrel 16 and is provided with a bushing 17 at the forward end which supports the forward end of the barrel 16 in the same manner as the larger caliber barrel. The bushing 17 is sized to accommodate the outside diameter of the sub-caliber barrel. The bushing 17 may be the same bushing used for the larger caliber barrel and is entirely dependent upon the outside diameter of the front end of the barrel. The sub-caliber barrel may have different outside diameters. For example a larger caliber barrel may be relined to the sub-caliber size or the sub-caliber barrel may have an enlarged front end having the same outside diameter as the larger caliber barrel. In either situation the barrel bushing used would be the same for both larger caliber and sub-caliber barrels. If the outside diameter of the front end of the sub-caliber barrel is smaller than the outside diameter of the larger caliber barrel then a sub-caliber barrel bushing would be required.

The slide and barrel are desirably locked in battery to each other by means of ribs (not shown) on the barrel which project upwardly into corresponding grooves in the slide. While being desirable, barrels manufactured or modified for use in the present invention do not require interlocking ribs to be functional, or safe. In either case, however, a fully locked breech is maintained.

The sub-caliber barrel 16 is connected to the frame 10 by means of a connecting link 19 which is pivoted to the barrel by pivot pin 20 and which is pivoted to the frame by means of a transverse pivot pin 21. Pivot pin 21 extends transversely through suitable holes in the frame 10 and is provided at its left hand end with a handle (not shown) by means of which the pin 21 can be removed and the sub-caliber barrel 16 released from the frame 10 when converting to the larger caliber barrel.

The slide and barrel are normally maintained in their forward positions by means of a recoil spring 22 abutting at the rear against a recoil spring guide which abuts against the bottom lugs and pivotal link of the barrel, and abutting at the front against a recoil spring plug detachably connected to the forward end of the slide. The recoil spring 22 for a sub-caliber use is tensioned to operate the slide as will be described, by the forces exerted by the firing of a sub-caliber cartridge. Since such forces are not as great as those exerted by firing a larger caliber cartridge, the spring for sub-caliber use is accordingly lighter or less stiff.

Attached to and carried by the frame 10 is the firing mechanism which remains that of the larger caliber pistol, with the exception of the hammer spring which is replaced by a hammer spring of lighter force or tension and used firing both caliber cartridges. Since the firing mechanism is not of itself part of the present invention, details are not shown. When the trigger 23 is pulled, the hammer 24 is released and moves forward to the position shown in FIG. 1. In moving, it strikes the end of firing pin 25 carried by the slide which moves forward protruding through the slide breech face recess to strike the primer in the cartridge case head. As the result of recoil, the barrel 16 and slide 14 moves rearwardly. The barrel 16 moves downwardly pivoting about connecting link 19, unlocking the breech, and the slide 14 continues to move rearwardly to move the hammer 24 back cocking the firing mechanism. The empty sub-caliber cartridge, captured by a cambered, relatively flexible extractor 26, mounted in extractor tunnel 27 of slide 14, is pulled out of the firing chamber of the barrel with the rearward movement of the slide and is thrown free of the pistol upon striking ejector 28. The slide is immediately returned to its forward position by means of recoil spring 22. During the forward movement a cartridge is withdrawn from the magazine 12 and pushed into the chamber of the barrel. Near the end of its forward movement the slide abuts against the head of the chambered cartridge case in the barrel so as to reverse the action of pivot link 19 such that the rear part of the barrel is elevated moving the barrel forward with the slide, locking the breech, and positioning and locking the newly inserted cartridge in firing position with the cartridge case head held in position against the breech face recess 15.

Figure 2:
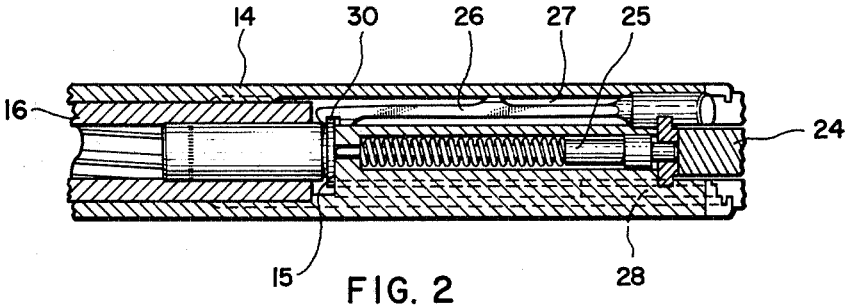
FIG. 2 is an enlarged partial horizontal section taken along lines 2—2 of FIG. 1, showing the modified extractor positioned in the slide.
Figure 3:
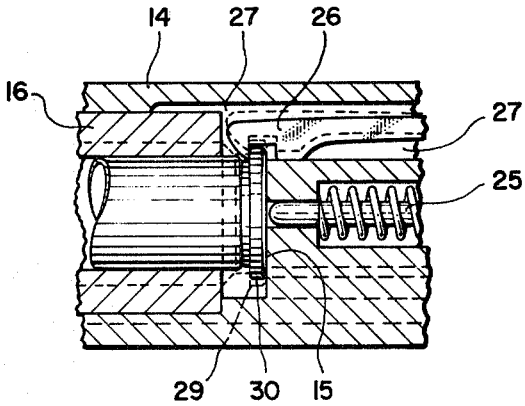
FIG. 3 is a fragmentary enlarged horizontal view of FIG. 2, showing the extractor extending into the breech toward the center line of the bore to capture a sub-caliber case rim with the extractor capturing a larger caliber case head being shown by phantom lines.
Figure 4:
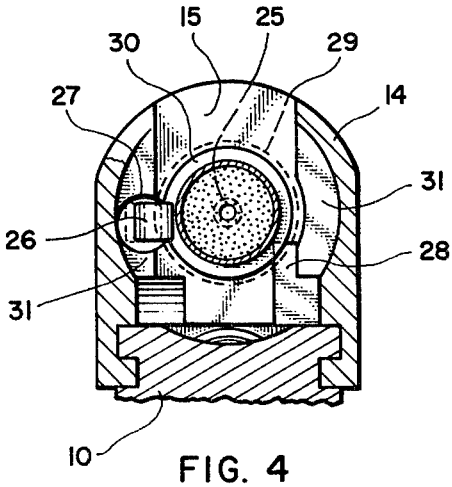
FIG. 4 is a fragmentary vertical section of the slide breech face taken along lines 4—4 of FIG. 1, showing the extractor capturing the sub-caliber case rim with the extractor capturing the larger caliber case rim being shown in phantom lines.

As shown in FIGS. 2, 3, and 4, the extractor 26 has a degree of lateral movement within the extractor tunnel 27 which is sufficient to capture the rim 29 of a larger caliber cartridge and also the rim 30 of a sub-caliber cartridge. This is made possible by providing an extractor that is cambered to capture the rims of both sizes of cartidge cases. Because of the camber, the extractor 26 will come into contact with a larger cartridge being fed from the magazine into the barrel when the pistol is being used to fire the larger caliber cartridges. By providing a degree of resiliency or flexibility to the cambered extractor 26 it will be moved outwardly in extractor tunnel 27 when contacted by the cartridge allowing the larger caliber cartridge to pass upward against the breech face of the slide and into the chamber of the barrel. The extractor is cambered to stay within the dimensional limits required by the diameter of the heads of the cases to be extracted. Thus, the same extractor is operative within the slide to extract both larger and sub-caliber cartridges.

FIG. 4 shows the positioning of cartridge case heads of a larger caliber case 29 and a sub-caliber case 30 against the cartridge locating recess 15 in the breech face of the slide. The larger caliber case head 29 is positioned by guides 31 and captured by extractor 26. When converted to sub-caliber use, the case head of a sub-caliber cartridge is not positioned by guides 31. However, considerable experimentation has shown that a sub-caliber cartridge will function equally as well as a larger caliber cartridge without modification of the cartridge locating recess 15. The chamber of the sub-caliber barrel 16 acts as a centering device for the sub-caliber case. When the sub-caliber case is chambered, the chamber of the barrel fixes the location of the case head 30 so that extractor 26 can capture the rim. Upon firing of a round, the extractor extracts the spent case from the chamber. The sub-caliber case is dragged backwardly in a straight line which is on line with the center of the bore. The extraction occurs so rapidly that the rim 30 of the sub-caliber case remains intact in the extractor 26 and against the face of the cartridge locating recess until the case head is brought into contact with the ejector 28 on the frame 10 which results in the ejection of the spent sub-caliber case from the ejection port of the slide.

The conversion of the larger caliber pistol to its sub-caliber counterpart or vice versa if effected rapidly. To change from the larger caliber to a sub-caliber, one need merely follow the same procedure as when stripping the pistol for cleaning or repairs. The larger caliber magazine is removed, followed by rotating the larger caliber barrel bushing and removing the recoil spring plug. The slide is retracted, the slide stop pin is removed, and the slide is removed from the frame along with the larger caliber barrel, recoil spring and barrel bushing. The larger caliber recoil spring, barrel and barrel bushing are separated from the slide. The sub-caliber barrel 16 is inserted into the slide 14 along with the barrel bushing 17, which may or may not be different and sub-caliber recoil spring 22. This assembly is inserted on the frame 10 with the sub-caliber barrel 16 being connected to the frame 10 by a pivotal link as was the larger caliber barrel. The slide is moved forward into position and the recoil spring plug is inserted and captured by the sub-caliber barrel bushing 17. The slide is cycled a few times by hand to make sure the converted sub-caliber mechanisms are operating properly and the sub-caliber magazine is inserted into the handle. The conversion to a sub-caliber pistol is thus completed.

While the above description discloses a preferred embodiment of the invention, it is to be understood that numerous modifications or alterations may be made without departing from the scope of the invention as set forth in the following claims.

I claim:

1. An interconvertible sub-caliber automatic pistol of the breech block type comprising the frame, handle, single pieced slide, ejector and firing mechanism of a larger caliber pistol interconnected with, (a) an interchangeable barrel of a sub-caliber slidably mounted in the slide and detachable secured to the frame by a pivotal connecting link, (b) an interchangeable barrel bushing detachable mounted into the forward end of the slide and appropriately sized to surround and support the forward end of the sub-caliber barrel, (c) an interchangeable recoil spring in the forward end of the slide below the barrel interposed between the front end of the slide and the frame sufficiently tensioned to hold the slide and barrel in a forward position but which allows the slide and barrel to recoil in the normal manner upon the firing of a sub-caliber cartridge thereby ejecting the fired cartridge, cocking the firing mechanism and reloading another cartridge into the chamber of the barrel, and (d) an interchangeable magazine adapted to hold sub-caliber cartridges mounted in the handle.

2. An interchangeable sub-caliber automatic pistol according to claim 1, wherein the cartridge locating recess in the breech face of the slide is that of the larger caliber and the extractor in the slide is flexibly cambered so as to capture and extract both larger and sub-caliber cartridges.

3. An interconvertible sub-caliber automatic pistol according to claim 2, wherein the larger caliber pistol is a 0.45 and the sub-caliber is a 0.38 special.

4. An interchangeable sub-caliber automatic pistol according to claim 3, wherein the larger caliber pistol is a Colt Government Model .45.

* * * * *